United States Patent [19]

Hose

[11] Patent Number: 4,741,060

[45] Date of Patent: May 3, 1988

[54] ARTICULATED WRENCH

[76] Inventor: Jack H. Hose, 4968 Ferro St., Long Beach, Calif. 90815

[21] Appl. No.: 855,491

[22] Filed: Apr. 24, 1986

[51] Int. Cl.[4] ..... B25F 1/00

[52] U.S. Cl. ..... 7/138; 7/166

[58] Field of Search ..... 7/138, 140, 166, 170, 7/168; 81/125.1, 124.3

[56] References Cited

U.S. PATENT DOCUMENTS

| | | | |
|---|---|---|---|
| 384,592 | 6/1888 | Ross | 7/138 |
| 518,328 | 4/1894 | Oakey | 7/138 |
| 896,512 | 8/1908 | Blauch | 7/138 X |
| 1,247,707 | 11/1917 | Morich | 7/138 X |
| 1,529,075 | 3/1925 | McIntyre | 81/125.1 |
| 4,646,378 | 3/1987 | Borden | 7/138 |

*Primary Examiner*—Debra Meislin

*Attorney, Agent, or Firm*—John Joseph Hall

[57] ABSTRACT

An articulated wrench having an elongated leg member with a slot in its shank portion and its outer end formed into a flange with a slot therein, and pivotally mounted at its inner end to the inner end portion of an arm member having a hook formed at its inner end, and having a slot in its outer end portion, and having two prongs formed at its outer end.

4 Claims, 3 Drawing Sheets

10
11
12
13
14
15
16
20
22
24
30
32
34
36
38
39
40
42
44
46
48
50
64
66

ARTICULATED WRENCH

SUMMARY OF INVENTION

This invention relates to an articulated wrench specially designed to turn conventional main water and gas supply valves on and off, easily and quickly. The articulated wrench has an elongated arm portion pivotally mounted at its inner end to the inner end of an elongated leg portion. The arm portion has a hook formed at the end connected to the leg, and a recess at its other end, the outer end, forming two prongs, and a longitudinal slot in the outer portion of the outer end.

The leg portion has its outer end formed into a toe portion at right angles to the axis of the leg portion. Both the toe portion and the outer portion of the leg's outer end are provided with a longitudinal slot.

The prior art discloses no wrench device with the structure and capability of the present invention. The wrench devices disclosed in U. S. Pat. No. 1,529,075 (McIntyre) and in U. S. Pat. No. 1,247,707 (Morich) are incapable of opening a cover of a recessed water meter having a main water supply valve, and then being inserted at right angles to the valve to rotate it off or on, because each lacks the toe structure and hook structure and recessed arm structure of the present invention.

Nor do such prior art wrenches have structures capable of access to a recessed gas supply valve to turn it off or on, as does the present invention.

It is, therefore, an object of this invention to provide an articulated wrench device capable of insertion into recesses for turning water supply valves off and on.

Another object of this invention is to provide an articulated wrench device capable of insertion into recesses for turning gas supply valves off and on.

A further object of this invention is to provide an articulated wrench device which has a capability of lifting conventional covers of recessed water meters and recessed water supply valves, preparatory to turning the water off or on.

A yet further object of this invention is to provide an articulated wrench which has structure capable of producing substantial leverage as needed for turning main supply gas or water valves off or on, which may be rusty or otherwise difficult to turn.

These and other objects will be more fully understood by reference to the following description and accompanying drawings, in which FIG. 1 is a perspective view of a preferred embodiment of the invention.

FIG. is a plan cross sectional view taken on lines 2—2 of FIG. 1.

FIG. 8 is a side elevational view of an embodiment of the invention in position for turning a water supply valve off or on.

FIG. 10 is a side elevational view of an embodiment of the invention in one position for turning a gas supply valve off or on.

FIG. 11 is a plan cross sectional view taken on lines 11—11 of FIG. 10.

FIG. 12 is a side elevational view of an embodiment of the invention in a second position for turning a gas supply valve off or on.

FIG. 13 is a plan cross sectional view taken on lines 13—13 of FIG. 12.

FIG. 14 is a side elevational view of an embodiment of the invention in a third position for turning a gas supply valve off or on.

FIG. 15 is a plan cross sectional view taken on lines 15—15 of FIG. 14.

Figure 1:
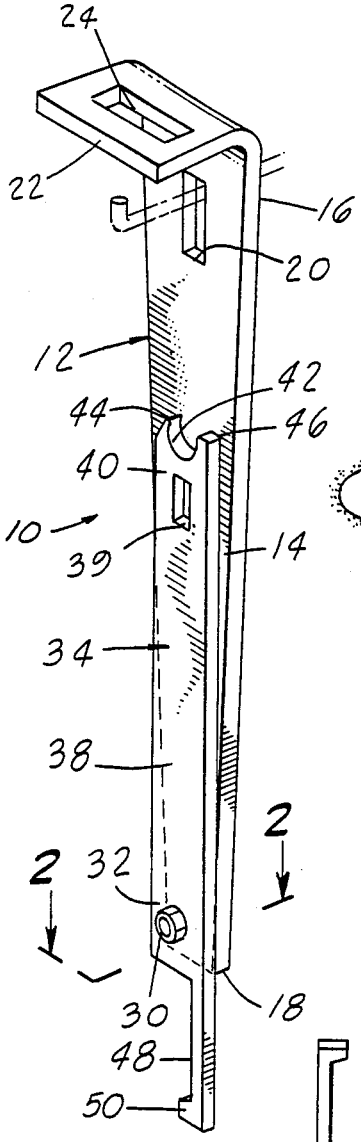
Figure 2:
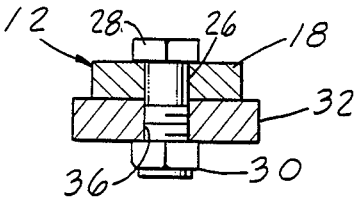

The articulated wrench 10 has an elongated leg member 12, preferably formed a shank portion 14 tapering inwardly from the outer end 16 leg member 12 to its inner end 18. The outer portion of the shank 14 is provided with a longitudinal slot 20.

The outer end 16 of leg member 12 has a toe member or flange member 22 which is formed at right angles to the axis of the shank 14 of leg member 12, and which is provided with a longitudinal slot 24.

An opening 26 in the inner end 18 of leg member 12 receives a threaded bolt 28 secured by nut 30 for pivotal connection of the inner end 18 of leg member 12 in the inner end 32 of elongated arm member 34 through opening 36 at the inner end 32.

The shank portion 38 of arm member 34 is preferably formed with parallel sides and is provided with a longitudinal slot 39 at its outer end portion. The outer end 40 of arm member 34 is provided with a recess 42 forming two prongs 44 and 46. Prong 46 is preferably somewhat blunter than prong 44.

The inner end 32 of arm member 34 terminates in a hook member 48, having a prong 50. The articulated wrench 10 is preferably made from $\frac{1}{4}$ inch thick hot rolled steel, which is zinc plated, although any material and thickness having the requisite strength may be used.

The arm member 34 is preferably about 2 inches wide and about 13 inches long for leverage. The hook member 48 is preferably about $2\frac{1}{2}$ inches long with a $\frac{1}{4}$ inch prong 50.

The leg member 12 is preferably about 14 inches long and $2\frac{1}{2}$ inches wide at its widest portion and is tapered to reduce its weight. The toe portion 22 is about $2\frac{1}{2}$ inches wide and $1\frac{3}{4}$ inches deep. Slots 20 and 39 are preferably about $1\frac{1}{2}$ inches long and $\frac{1}{2}$ inch wide in dimensions, while slot 24 is preferably about $1\frac{3}{4}$ inches long and $\frac{3}{8}$inch wide in dimensions.

The distance separating prongs 44 and 46 is preferably about $\frac{1}{2}$ inch.

The dimensions of slots 20, 24, and 39 are critical because they must correspond to the dimensions of valve handles commonly used by water and gas service companies in the State of California, and elsewhere. Similarly, the separation between the prongs 44 and 46 is also critical, because the separation must correspond with the distance between holes in round covers commonly used for water meters and water supply valves in the State of California and elsewhere.

Also, the hook 48 has a critical dimension of its prong 50 of about ½ inch, so that it may be inserted into the openings commonly used for square or rectangular covers for water meters and water supply valves commonly used in the State of California and elsewhere. In operation for turning main water supply valves, the articulated wrench 10 is first employed to remove any existing covers over the water valves.

Figure 3:
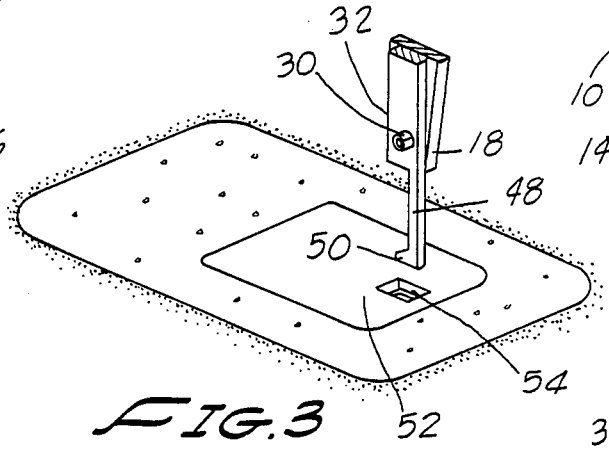
FIG. 3 is a perspective view of a conventional type of cover for a water meter and main water supply valve and of the structure of the invention capable of removing the cover.
Figure 4:
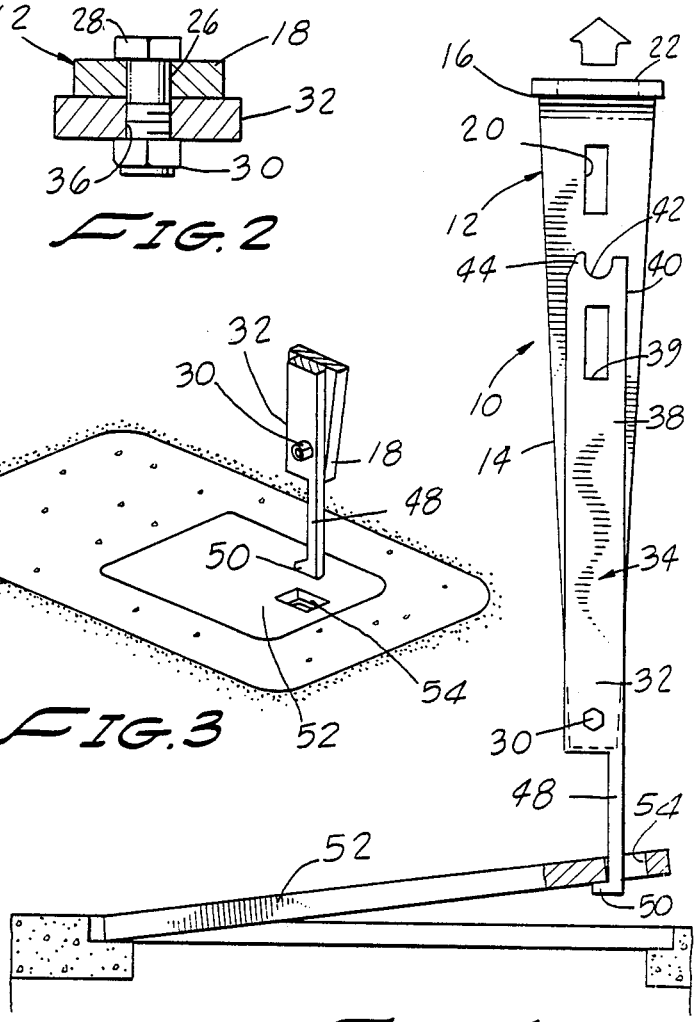
FIG. 4 is a side elevational view illustrating the removal of the cover of FIG. 3 by the invention.

Water meters and water valves that are covered with a square or rectangular cover 52 have a small opening 54 through which the hook 48 can be inserted to lift off the cover 52, as shown in FIG. 3.

Figure 5:
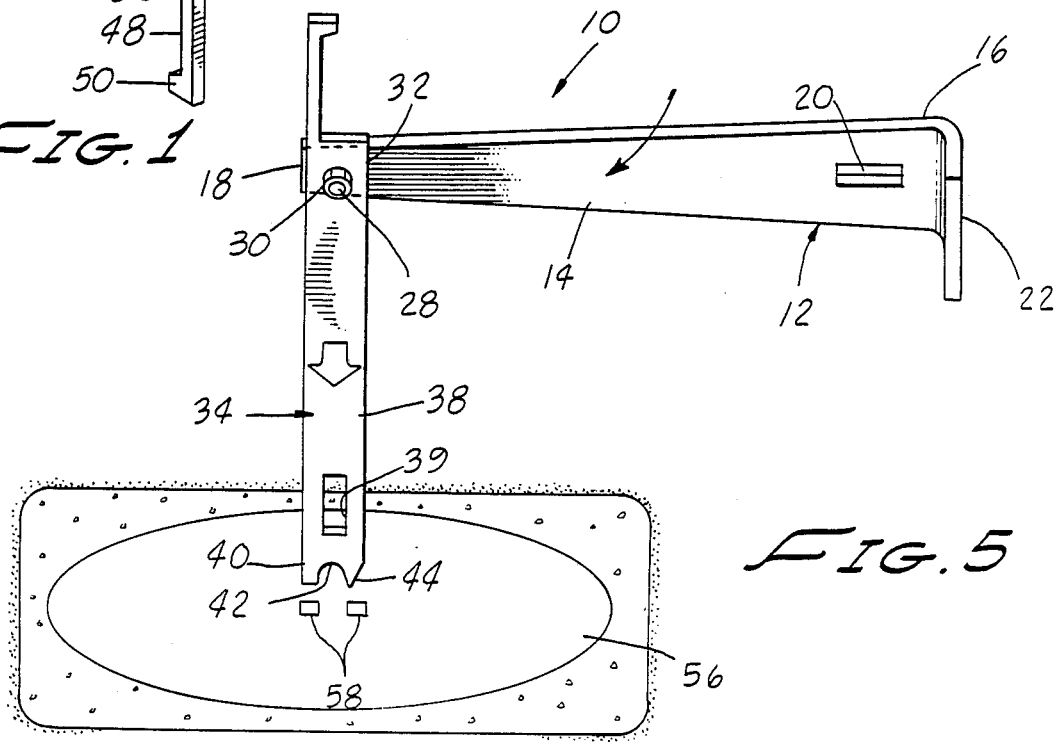
FIG. 5 is a perspective view of another type of cover for a water meter and main water supply valve and of the structure of capable of removing it.
Figure 6:
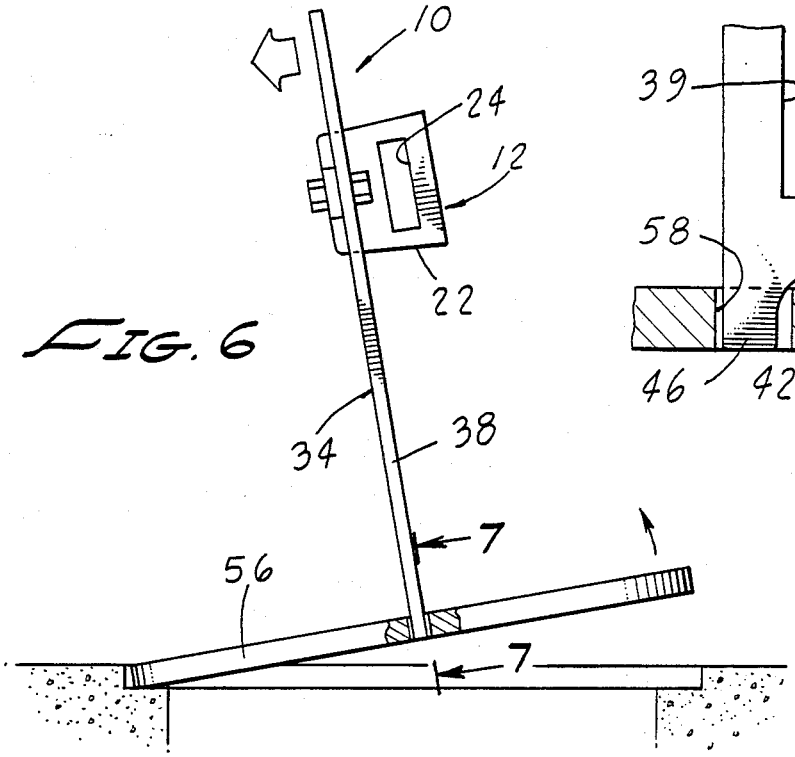
FIG. 6 is a side elevational view illustrating the removal of the of FIG. 5.
Figure 7:
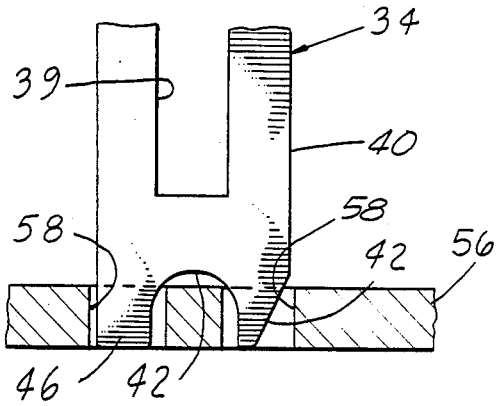
FIG. 7 is a fragmentary cross sectional view taken on lines 7—7 of FIG. 6.
Figure 8:
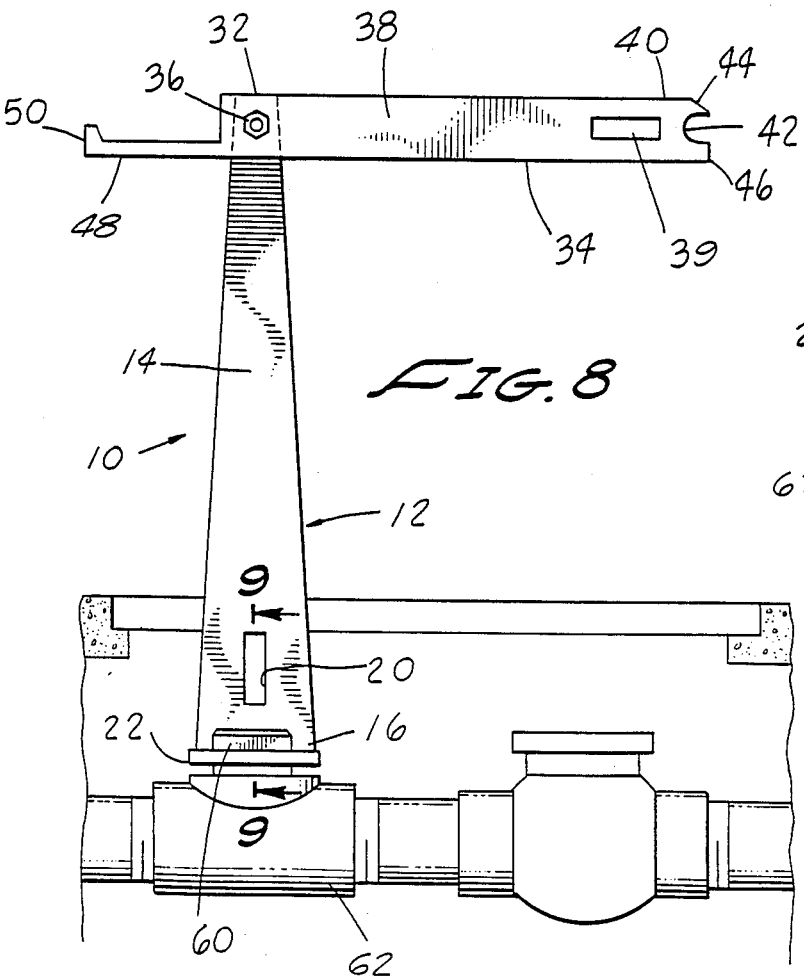
Figure 9:
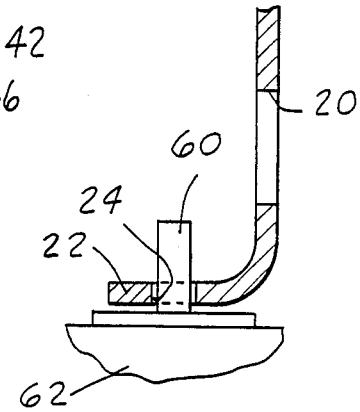
FIG. 9 is a plan cross sectional view taken on lines 9—9 of FIG. 8.

Water meters and water valves that are covered with a round cover 56 have two holes 58 in the cover 56. The prongs 44 and 46 of arm member 34 are inserted into the holes 58 and the articulated wrench 10 is then turned sufficiently, preferably 90°, to pry off and then to lift up the cover 56, as shown in FIGS. 5, 6, and 7.

Holes 58 in cover 56 are usually ¼ inch in diameter, but one hole of some covers 56 may be ⅜ inch in diameter. To accommodate such a larger hole more readily, prong 46 is formed blunter than prong 44 and is preferably about ¼ inch wide at its tip After removal of cover 52 or 56, as the case may be, slot 24 of toe portion 22 is placed around the handle 60 of the water valve 62 and the arm member 34 is raised to a position that is at right angles with leg portion 12 for leverage. Turning the arm member 34 180° will then turn leg member 12 and the handle 60 180° also, so that the water valve 62 may be turned off or on as desired.

Figures 10, 11, 12, 13, 14, 15:
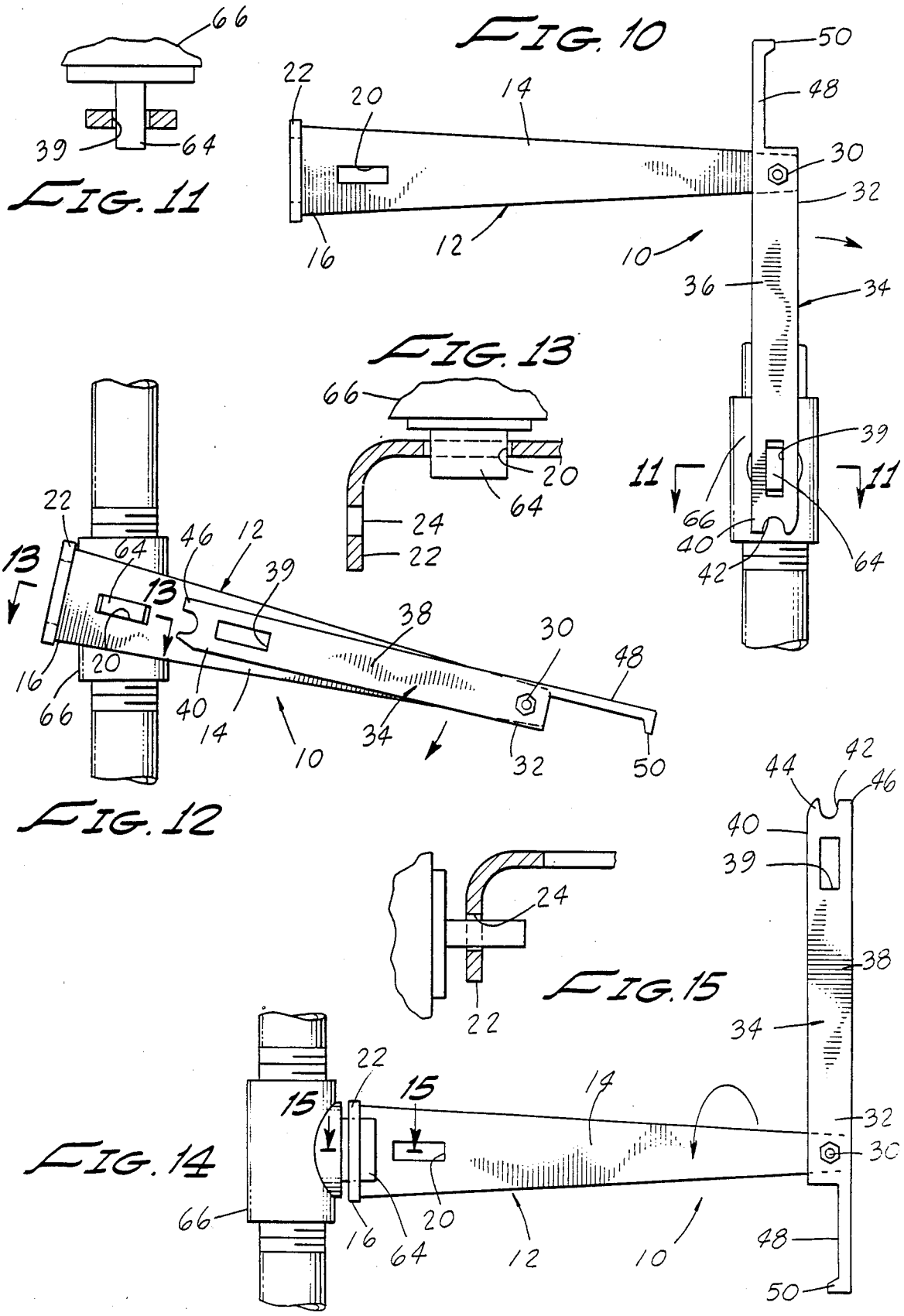

The articulated wrench 10 provides three alternate ways of turning gas valves off or on. As shown in FIG. 10, the slot 39 of arm member 34 is placed around the gas handle 64 of gas valve 66. Leg portion 12 is raised at right angles to arm member 34 and the articulated wrench 10 is rotated as shown in FIG. 10. Rotation of gas handle 64 90° will open or close gas valve 66.

FIG. 12 shows the articulated wrench 10 in a closed position with slot 20 of leg portion 12 placed around the handle 64 of gas valve 66. Rotation of articulated wrench 10 to 90° will close or open gas valve 66 as desired.

For recessed gas valves that are relatively inaccessible and difficult to operate by conventional tools, a third position of articulated wrench 10 provides easy and rapid operation of gas handle 64.

The slot 24 of the toe portion 22 of the leg member 12 is placed around the handle 64 of gas valve 66. Arm member 34 is raised to a vertical position at right angles to leg member 12. Rotation of the articulated wrench 10 90° will close or open the gas valve 66 as desired.

Although I have described my invention with respect to preferred embodiments, it is understood that various modifications and changes may be made in the location and form of the various elements without departing from the spirit and scope of the invention as defined in the following claims.

I claim:

1. An articulated wrench comprising:

a solid, unitary, elongated leg member having an inner end and an outer end formed flat throughout its length and having its width gradually increasing to about 2½ inches at said outer end, said outer end having a flange attached thereto with a slot about 1¾ inches long and about ⅝ inch wide in said flange;

a solid, unitary, elongated arm member formed flat throughout its length and having a hook integrally formed at its inner end in the same plane as said arm member and having its outer end formed integrally into a pair of spaced prongs in the same plane as said arm member, said arm member adapted to be superimposed on said leg member by means pivotally connecting the inner end of said leg member with said inner end of said arm member between opened and closed positions of use.

2. An articulated wrench according to claim 1 in which said elongated leg member has a longitudinal slot in said outer end, said slot being about 1½ inches long and about ½ inch wide.

3. An articulated wrench according to claim 1 in which said flange is formed at right angles to the axis of said elongated leg member and is about 2½ inches in width.

4. An articulated wrench comprising:

a solid, unitary, elongated leg member having an inner end and an outer end formed flat throughout its length with its width gradually increasing to about 2½ inches at said outer end, and having a longitudinal slot in said outer end, said outer end having a flange attached thereto and being at right angles to the axis of said leg member, said flange having a slot about 1¾ inches long and about ⅝ inch wide and having a width of about 2½ inches;

a solid, unitary, elongated arm member formed flat throughout its length and having a hook about 2½ inches long integrally formed at its inner end in the same plane as said arm member and having its outer end formed integrally into a recess formed between two prongs spaced about ½ inch apart in the same plane as said arm member, said arm member adapted to be superimposed on said leg member by means pivotally connecting the inner end of said leg member with said inner end of said arm member between opened and closed positions of use.

* * * * *